US006450113B1

(12) United States Patent
Onweller

(10) Patent No.: US 6,450,113 B1
(45) Date of Patent: Sep. 17, 2002

(54) MARINE MOORING LINE VERMIN SHIELD

(76) Inventor: Arthur E. Onweller, 5052 S. Syndt Rd., Evergreen, CO (US) 80439

( * ) Notice: Subject to any disclaimer, the term of this patent is extended or adjusted under 35 U.S.C. 154(b) by 0 days.

(21) Appl. No.: 09/683,526

(22) Filed: Jan. 14, 2002

(51) Int. Cl.[7] ..... B63B 9/00
(52) U.S. Cl. ..... 114/221 R
(58) Field of Search ..... 114/221 R; 43/58, 43/124, 43.1–43.13, 44.9–44.99; D8/356; D22/134, 144; 248/65, 74.1–74.3; 24/127, 129 R, 115 R, 130, 131 C, 132 R, 133, 134 KA, 132 AA

(56) References Cited

U.S. PATENT DOCUMENTS

| | | | |
|---|---|---|---|
| 1,060,993 | A | 5/1913 | Maynard |
| 1,401,540 | A | 12/1921 | Konig |
| 1,486,417 | A | 3/1924 | Cheely |
| 2,525,234 | A | 10/1950 | Mucke |
| 2,617,378 | A | 11/1952 | Osol |
| 3,005,436 | A | 10/1961 | Caldwell |
| 3,753,416 | A | 8/1973 | Haglund et al. |
| 4,570,564 | A | 2/1986 | Salvarezza |
| 4,769,943 | A | 9/1988 | Simpson |
| 4,782,622 | A | 11/1988 | Roberts |
| 4,890,416 | A | 1/1990 | Roberts |
| 5,184,415 | A | 2/1993 | Hattenbach et al. |
| 5,570,652 | A | 11/1996 | Ferland |
| 6,011,219 | A | 1/2000 | Casmero |
| D421,088 | S | 2/2000 | Douglas |

*Primary Examiner*—S. Joseph Morano
*Assistant Examiner*—Ajay Vasudeva
(74) *Attorney, Agent, or Firm*—Roger A. Jackson

(57) ABSTRACT

A marine mooring line vermin shield to prevent the passage of vermin crawling along a marine mooring line from land to a pleasure craft, including a disc with a centrally located aperture through the disc, and a slot extending from the aperture to a periphery of the disc. The vermin shield also includes a closure that is urged to insert into the disc slot in a closed state compressing the mooring line against the aperture to secure the vermin shield onto the mooring line. The closure may also be locked in the closed state. The closure can also be extracted from the disc slot in an open state to allow the mooring line to be removed from the aperture through the slot past the disc periphery.

19 Claims, 4 Drawing Sheets

MARINE MOORING LINE VERMIN SHIELD

TECHNICAL FIELD

The present invention generally relates to vermin control in a marine environment. More particularly, the present invention relates to preventing the passage of vermin crawling along a mooring line of a recreational pleasure craft from the shoreline and onto the pleasure craft.

BACKGROUND OF INVENTION

It has long been recognized in the prior art the problem of a vermin infestation of marine vessels who migrate from the shore line whether it is a dock, a marina, a beach, or any other means possible with the vermin crawling from land onto the marine vessel wherein the vermin are attracted to food, water, and an enclave for nesting in the hold of the marine vessel. Once the vermin are on the marine vessel numerous problems arise, such as sanitation issues with the food and water supply of the marine vessel and other safety issues wherein the vermin can chew on wiring insulation in the hold of the vessel potentially causing electrical short circuits and possibly fires. Trapping and catching vermin has proved difficult as they are nocturnal animals, and can move very swiftly, and have the ability to squeeze through a very small crevices and openings in the hold of the vessel. Once the vermin have nested in the hold of the vessel it is typically required that the vessel be fumigated and then attempt to remove the dead vermin from the vessel. From the smallest to the largest vessels it is frequently very difficult even after fumigation to remove all of the dead vermin which in time works to create unsanitary conditions from the decaying vermin carcasses.

As all marine vessels must of necessity be anchored or docked occasionally on either the beach or a dock where there is a mooring line that is strung between the cleats typically on the deck of the vessel and on the dock, or between the cleat on the deck of the vessel and an anchor that is on the shoreline. Even though the vessel is typically surrounded by least 6 ft. laterally of water, the vermin has ready access to the vessel by simply crawling along the mooring line from the dock or shoreline and onto the vessel itself. It has long been recognized in the prior art that the use of a shield barrier placed upon the mooring line to obstruct the vermin's ability to crawl along a mooring line and onto the ship is a solution to this problem.

Typical prior art solutions have included the use of a disc or a plurality of discs that are split in a semi circular fashion to be able to clamp upon the mooring line so that the disc assembly is secured in place upon the mooring line, as the mooring line is typically at an inclined angle with respect to the water level and the shoreline. A number of the prior art devices also include a vermin trap that sometimes has a poisonous substance inside wherein the vermin upon crawling up the morning line and encountering the barrier are trapped inside the barrier and subsequently killed. U.S. Pat. No. 1,060,993 to Maynard and U.S. Pat. No. 4,890,416 to Roberts disclose this type of vermin guard. Other similar types of vermin guards do not have the vermin trap and poisonous substance, but are of a very similar design in other respects namely U.S. Pat. No. 1,401,540 to Konig, U.S. Pat. No. 1,486,417 to Cheely, U.S. Pat. No. 5,570,652 to Ferland, and U.S. Pat. No. 2,617,378 to Osol all utilize the aspect of only having a physical barrier to stop the vermin from migrating or crawling along the mooring line onto the vessel. There are some more unique designs of vermin guards for vessels that attempt to overcome specific problems, one of which is when a vermin guard is used on a very large vessel such as a ship, gaining physical access to the mooring line can be difficult as the morning line can be suspended much higher than a human's height above the water level. It is typically desired that the vermin guard be placed at an appreciable distance from the dock or shoreline, being at least 6 ft. or so to preclude the vermin from easily getting access to the mooring line on the vessel side of the barrier. Thus, some of the vermin guards have been designed to be installed on the mooring line remotely from the vessel deck. This is accomplished through the use of remote ropes or cables to the vermin guard to allow the mooring line clamping mechanism of the vermin guard to be opened and to then be clamped upon the mooring line by an individual on the vessel deck utilizing the attached ropes or cables. Examples would be U.S. Pat. No. 4,570,564 to Salvarezza, U.S. Pat. No. 3,753,416 to Haglund et al., U.S. Pat. No. 3,005,436 to Caldwell, and U.S. Pat. No. 2,525,234 to Mucke, of which all disclose the ability to remotely mount and dismount the vermin guard from the mooring line.

Salvarezza and Haglund et al., utilize a swinging door closure that clamps on the mooring line by virtue of gravity, Caldwell utilizes a resilient member to clamp on the mooring line, and Mucke utilizes a spring clamp to secure the vermin guard to the mooring line. One other type of vermin guard utilizes only a repellent type substance wrapped around a mooring line absent a physical barrier for the vermin crawling along the mooring line is disclosed in U.S. Pat. No. 4,769,943 to Simpson.

The majority of the aforementioned prior art has been designed for use with large vessels with the possible exception of Roberts and Simpson who both utilize a poisonous substance to prevent the vermin from crawling along the morning line to the vessel. As the use of a poisonous substance in conjunction with pleasure craft or recreational boating is not desirable due to the presence of children and various other reasons, there remains a need for vermin guard that is specifically designed for smaller recreational pleasure marine craft that utilizes a physical barrier only without the use of a poisonous substance to prevent vermin from crawling along and mooring line. The vermin guard for smaller craft should also be small, lightweight, easy to install, inexpensive to produce, lockably secured to the mooring line, and desirably float on the water if the vermin guard were inadvertently dropped into the water.

SUMMARY OF INVENTION

An object of the present invention is to prevent the passage of vermin crawling along a marine mooring line from the shoreline and onto the pleasure craft.

It is another object of the present invention is to provide for easy installation and removal of the marine mooring line vermin shield from the mooring line.

It is still another object of the present invention to provide for a locking mechanism to selectively secure the marine mooring line vermin shield to the mooring line to prevent theft of the morning line vermin shield.

According to the present invention, then, a marine mooring line vermin shield is provided to prevent the passage of vermin crawling along a marine mooring line from land to a pleasure craft. Broadly, the present invention includes a disc having a disc axial axis perpendicular to a face of the disc, the disc axial axis being positioned in a central portion of the disc. The disc also includes an aperture through the disc with the disc axial axis being positioned such that the aperture uses the disc axial axis as a centerline, the aperture is sized and configured as a passage for the marine mooring line. The disc also includes a radial slot through the disc in the disc axial axis, the radial slot extends from the aperture to a periphery of the disc, the slot also has a radial axis that is parallel to the slot. The marine mooring line vermin shield also includes a closure that is sized and adapted to insert into the slot in a closure axis approximately parallel to the disc axial axis, the closure is in a closed state when inserted into the slot and is substantially flush with the disc face when the closure is in the closed state. The closure is also sized and adapted to extract from the slot in the closure axis approximately parallel to the disc axial axis, with the closure being in an open state when extracted from the slot to allow the marine mooring line to pass through the slot from the periphery to the aperture of the disc. A means for urging the closure from the open state to the closed state is also included.

These and other objects of the present invention will become more readily appreciated and understood from a consideration of the following detailed description of the exemplary embodiments of the present invention when taken together with the accompanying drawings, in which;

REFERENCE NUMBER IN DRAWINGS

Figure 1:
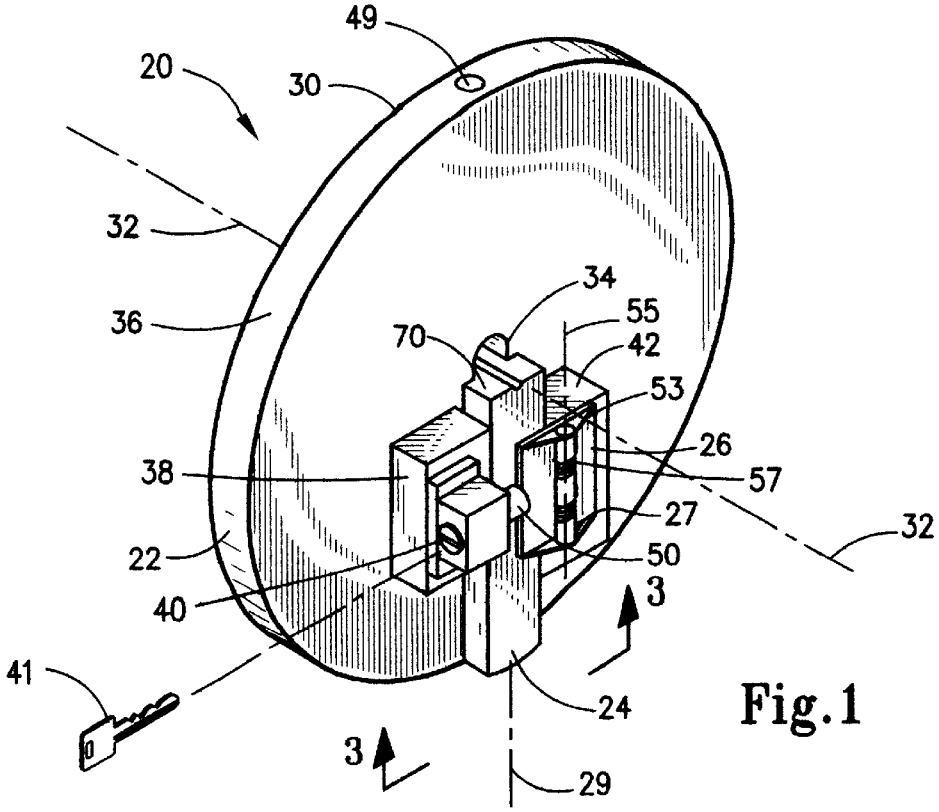
FIG. 1 shows a perspective back view of the marine mooring line vermin shield assembly with the closure inserted into the disc slot, resulting in the closure being in a closed state secured by the lock.

20 Marine mooring Line Vermin Shield Assembly
22 Disc
23 Disc shell
24 Closure
25 Closure axis
26 Means for urging closure from the open state to the closed state
27 Hinge pivot
28 Slot in disc for mooring line
29 Slot radial axis
30 Disc face
31 Placement area for pleasure craft registration number
32 Disc axial axis perpendicular to disc face
34 Disc aperture
36 Disc periphery
38 Lock support
40 Lock
41 Key
42 Support for closure urging means
44 First disc closure rest
46 Second disc closure rest
48 Disc closure clearance taper
49 Plug
50 Lock extension
51 Means for attaching plug to disc
52 Lock fastener
53 Hinge
54 Means for urging closure fastener
55 Pivotal axis
56 First disc closure clearance
57 Spring element
58 Second disc closure clearance
60 First closure rest
62 Second closure rest
64 Closure clearance taper
66 Foam void
68 Foam filling
69 Compression of marine mooring line
70 Closure mooring line grip
71 Marine mooring line axial axis
72 Marine mooring line
73 Axial movement along marine mooring line
74 Land including shoreline or dock
76 Body of water
78 Pleasure craft
79 Pleasure craft cleat
80 Vermin
81 Dock cleat
82 Anchor

DETAILED DESCRIPTION

The present invention generally relates to vermin control in a marine environment, specifically the present invention relates to preventing the passage of vermin crawling along a mooring line of a recreational pleasure craft from the shoreline onto the pleasure craft to prevent vermin infestation of the pleasure craft, wherein vermin are difficult to remove from the pleasure craft once the infestation occurs. According to the present invention, then, a marine mooring line vermin shield is provided to prevent the passage of vermin crawling along a marine mooring line from land to a pleasure craft. Broadly, the present invention includes a disc having a disc axial axis perpendicular to a face of the disc, the disc axial axis being positioned in a central portion of the disc. The disc also includes an aperture through the disc with the disc axial axis being positioned such that the aperture uses the disc axial axis as a centerline, the aperture is sized and configured as a passage for the marine mooring line. The disc also includes a radial slot through the disc in the disc axial axis, the radial slot extends from the aperture to a periphery of the disc, the slot also has a radial axis that is parallel to the slot. The marine mooring line vermin shield also includes a closure that is sized and adapted to insert into the slot in a closure axis approximately parallel to the disc axial axis, the closure is in a closed state when inserted into the slot and is substantially flush with the disc face when the closure is in the closed state. The closure is also sized and adapted to extract from the slot in the closure axis approximately parallel to the disc axial axis, with the closure being in an open state when extracted from the slot to allow the marine mooring line to pass through the slot from the periphery to the aperture of the disc. A means for urging the closure from the open state to the closed state is also included.

With initial reference to FIG. 1, shown is a perspective back view of the marine mooring line vermin shield assembly with the closure inserted into the disc slot, resulting in the closure being in a closed state secured by the lock. More specifically, the marine mooring line vermin shield assembly 20 is shown in a perspective view from the side opposite of the substantially flush disc face 30 to clearly identify the components of the closure 24, the means for urging 26 the closure 24 from the open state to the closed state and the lock 40. Also shown are the key 41 for the lock 40 and a plug 49 that mounts in the periphery 36 of the disc 22. The disc 22 as shown assumes a round periphery 36 with one substantially flush disc face 30 and an opposite sided disc face shown that includes detail on the closure 24, the means for urging 26 the closure 24 from an open state to closed state and the lock 40. Although the disc periphery 36 as shown is round in shape it would be acceptable for the disc periphery 36 to assume a number of different configurations depending upon manufacturing, shipping, and use considerations. The disc periphery 36 could be square, rectangular, elliptical, egg shaped, or a polygon with any number multiple straight sides. Materials of construction for the disc 22 are preferably of a material that is both corrosion resistant in a marine atmosphere or environment and a material that has a mass density less that the mass density of water, to allow the disc to float in water while supporting the additional elements of the closure 24, the means for urging 26 the closure into a closed state and the lock 40. The preferred materials of construction for the disc 22 include a plastic that is both light in weight, strong, and easily manufactured. These disc 22 materials of construction could include polyethylene, polypropylene, and polyurethane type materials, however, the disc 22 materials would not be limited to the aforementioned plastics as any suitable alternative material for both manufacturing and use of the disc 22 would be acceptable. Alternatively, the disc 22 could have a two-part construction of a plastic shell and an interior foam core, wherein the interior foam core has a lower mass density than the plastic shell material as shown in more detail in FIG. 7, wherein the foam is injected at the point where plug 49 inserts into the disc periphery 36. The purpose of the plug 49 is to prevent water saturation of the foam core in the disc 22. Also shown is the aperture 34 of the disc 22 that is a semi circular opening that utilizes the disc axial axis 32 as a centerline. The disc axial axis 32 is positioned in a central portion of the disc 22 has shown.

The closure 24 as shown is in the closed state by being inserted into the slot (not shown) as urged by the means for urging 26 the closure 24 from the open state to the close state. The materials of construction for the closure 24 are preferably the same as the materials of construction for the disc 22. The closure 24 has a mooring line grip portion 70 that acts to compress the mooring line and add frictional resistance to the mooring line moving relative to the closure 24. The opening formed by the disc 22 aperture 34 and the grip portion 70 provides a passageway for the mooring line which is shown more clearly in FIG. 7 and FIG. 8. The means for urging 26 the closure 24 from the open state into the closed state can be accomplished by any number of different methods. Preferably, as shown a hinge 53 having a pivotal axis 55 is mounted on the closure 24 as shown and between a support for the closure 42. The attachment for the hinge 53 to both the closure 24 and the support 42 is given in more detail in FIG. 5. The materials of construction for the support 42 are preferably the same as for the disc 22. A slot radial axis 29 is shown to be substantially parallel to the hinge pivotal axis 55 to facilitate the closure 24 inserting into the slot (not shown) when the closure 24 is in the closed state. The hinge 53 also includes a hinge pivot 27 and a spring element 57 to bias or urge the hinge to place the closure 24 in a closed state as shown. The materials of the hinge 53, including the hinge pivot 27, and the spring element 57 are also constructed of a corrosion resistant material suitable for a marine environment. Preferably, the hinge 53 is a Brainerd model number 160XC available from Brainerd Manufacturing in East Rochester, N.Y. 14445. However, many other alternatives would be suitable for the means for urging the closure 24 from an open state to close state. These would include a solid resilient piece of material, a flexible band of metallic material, or any other suitable means for urging the closure 24 into the closed state as shown suitable for operation in a marine environment.

The lock 40 is shown mounted on a lock support 38 to place the lock 40 and the hinge 53 at the same elevation in relation to the disc axial axis 32. The purpose of this is to allow the lock 40 with the locked extension 50 being extended to secure the closure 24 in a closed state as shown to prevent theft of the mooring line vermin shield assembly 20 from the mooring line. The lock support 38 is also preferably constructed of the same materials as a disc 22. The lock 40 as shown with the key 41 is preferably a Prime-Line model number U-9862 available from Prime-Line, of San Bernardino, Calif. 92407. The lock 40 has an axially movable bar that is retracted in the unlocked state and extended in the locked state as will be more clearly shown in FIG. 3 and FIG. 4. It is desired that the lock 40 be constructed of corrosion resistant materials suitable for a marine environment. Alternatively, the lock 40 could be any type of device that accomplishes the desired feature of securing the closure 24 in the closed state as shown. Both the lock support 38 and the hinge support 42 are not necessarily required as long as the hinge 53 in the lock 40 can act to secure the closure 24 and a closed state, given the configuration of the closure 24. Also, the lock 40 can be optional as it is not required to use the mooring line vermin shield 20, and the means for urging the closure 26 will keep the closure 24 in the closed state to obstruct the vermin from going past the vermin shield 20 while crawling along the mooring line (not shown).

Figure 2:
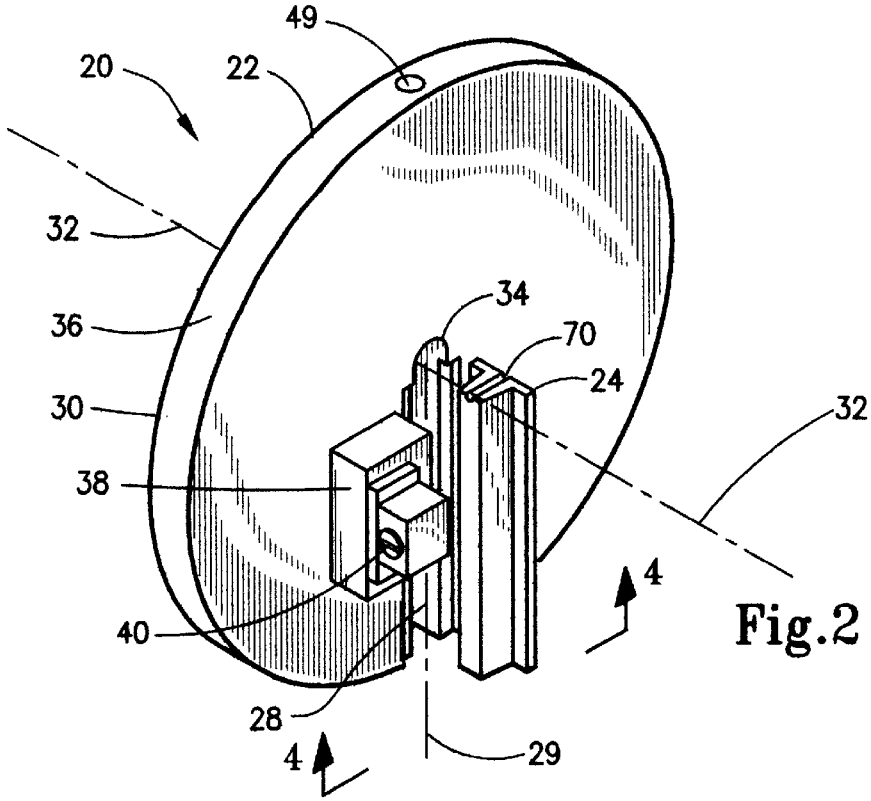
FIG. 2 shows a perspective back view of the marine mooring line vermin shield assembly with the closure extracted from the disc slot, resulting in the closure being in an open state.

Moving next to FIG. 2, shown is a perspective back view of the marine mooring line vermin shield assembly with the closure extracted from the disc slot, resulting in the closure being in an open state. More specifically, the marine mooring line vermin shield assembly 20 is shown in a perspective view from the side opposite of the substantially flush disc face 30 to clearly identify the components of the closure 24 and the lock 40. Also shown is a plug 49 that mounts in the periphery 36 of the disc 22. Also, as shown is the aperture 34 of the disc 22 that is a semi circular opening that utilizes the disc axial axis 32 as a centerline. The disc axial axis 32 is positioned in a central portion of the disc 22 as shown.

The closure 24 as shown is in the open state by being extracted from the slot 28 as urged by a manual means, in other words opening by hand or other tool, moving the closure 24 to extract and pivot away from the slot 28 thereby overcoming the opposing means for urging 26 the closure 24 from the open state to the closed state (not shown). The closure 24 has a mooring line grip portion 70 that acts to compress the mooring line and add frictional resistance to the mooring line being able to move relative to the closure 24 in the closed state, note the open state is shown to more clearly show the grip portion 70. The grip portion 70 of the closure 24 can be accomplished by any number of means such as having a high friction surface with undulations, grooves, teeth, and the like. The opening formed by the disc 22 aperture 34 is tangential to the slot 28 with the slot 28 width and aperture 34 diameter being substantially the same dimension as shown. The slot 28 goes through the disc 22 in the disc axial axis 32 and is shown that the slot 28 radially extends from the aperture 34 to the periphery 36 of the disc 22. The grip portion 70 provides a portion of the passageway for the mooring line which is shown more clearly in FIG. 7 and FIG. 8. A slot radial axis 29 is shown to be substantially parallel to the slot 28 to more clearly show its location in relation to the pivotal axis 55 as described in FIG. 1. The lock 40 is shown mounted on a lock support 38 to support the lock 40. The lock 40 has an axially movable bar that is retracted in the unlocked state with the lock shown in the retracted position allowing the closure 24 to be extracted from the slot 28 as shown being placed in the open state.

Figure 3:
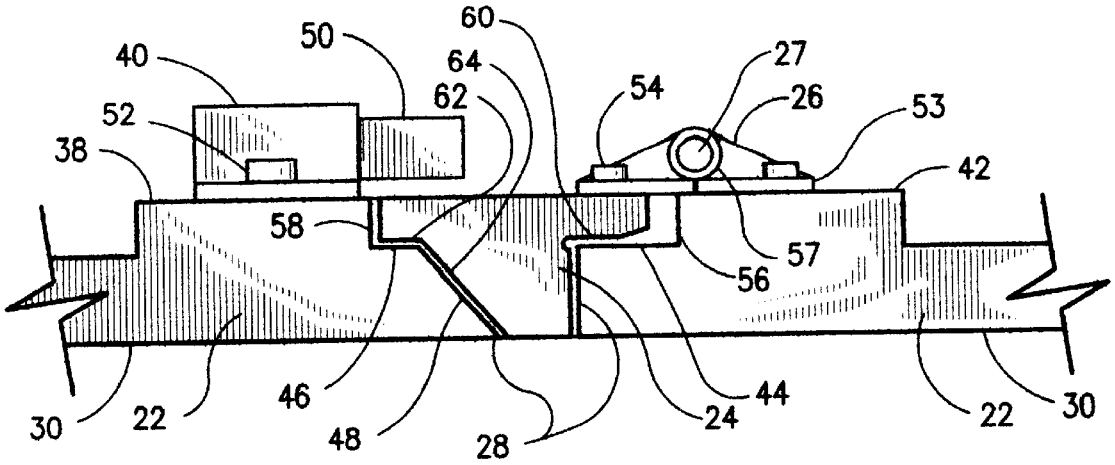
FIG. 3 shows an end view of the marine mooring line vermin shield assembly with the closure inserted into the disc slot, resulting in the closure being in a closed state secured by the lock.

Further to FIG. 3, shown is an end view of the marine mooring line vermin shield assembly with the closure inserted into the disc slot, resulting in the closure being in a closed state secured by the lock. Starting with the disc face 30, note that the closure 24 is sized and adapted to insert into the slot 28 such that the disc face 30 and closure 24 form a substantially flush surface, as the disc face 30 is what the vermin will encounter when crawling up the mooring line. As the closure 24 is shown in the closed state, the closure 24 is urged into that position by the means for urging 26 the closure 24 into the closed state. As is shown, the means for urging 26 the closure 24 includes the hinge 53, the spring element 57 that pivots at the hinge pivot 27. As it is desirable to have a closure 24 be substantially flush with the disc face 30 of the disc 22 when the closure 24 is in the closed state, there are two rests on each side of the disc slot 28. There is a first disc closure rest 44 and a second disc closure rest 46, these respective rests support the closure 24 at the first closure rest 60 and second closure rest 62. There is a gap shown in FIG. 3 between these closure and disc rests for pictorial clarity, however, in actuality the aforementioned disc and closure rests are in contact and act as a gauge to set the closure 24 positioning within the disc slot 28. The result of this is to form a substantially flush disc face with the closure 24 in a closed state at the disc face 30.

The lock 40 is also shown in a locked state with the locked extension 50 extended to prevent the closure 24 from being extracted from the slot 28 into the open state, in other words the lock 40 and extension 50 as shown act to secure the closure 24 in the closed state as shown to prevent theft of the mooring line vermin shield. Both the lock 40 and the hinge 53 are mounted on respective supports being a lock support 38 and the hinge support 42, this is to allow the lock 40 and the hinge 53 to be at the same elevation to enable the closure 24 to be secured in the closed state. Alternatively, these respective supports for the lock 38 and for the hinge 42 could be of a different height or even flush with the remaining disc 22 as long as the capabilities are preserved of having the closure 24 move from a closed to an open state, with the closure being urged or biased to the closed state, and secured by the lock 40 in the closed state. Fasteners are shown for securing the lock 40 to its respective support 38 and the hinge 53 to its respective support 42. These fasteners 52 for the lock 40 and fasteners 54 for the hinge 53 to the support 42 can be constructed of preferably stainless steel rivets that go completely through the disc 22 out of materials being acceptable for a marine environment. Alternatively, screws, bolts, or adhesive would be acceptable for the fasteners 52 and 54 as long as the operational requirements were met of having adequate attachment strength and suitability for a marine environment to secure both the lock 40 to the lock support 38 and the hinge 53 to the support 42. The slot 28 also includes lateral clearances and a clearance taper which allows the closure 24 to be extracted and inserted into the slot utilizing the hinge 53 as a pivot point when the closure is moved from the open state to the closed state and vice versa with the lock 40 in the unlocked state. This essentially allows a "swing" clearance for the closure 24 for insertion and extraction from the slot 28. These lateral clearances are a first disc closure clearance 56 and a second disc closure clearance 58, to allow the pivotal movement of the closure 24 at the hinge pivot 27. Also, a mating taper portion between the closure 24 and the slot 28 is described. The taper portion in the slot 28 is termed the closure clearance taper 48 and has a close clearance mating with a close clearance taper 64 for the closure 24. This taper combination in conjunction with the lateral clearance as previously described allow the closure 24 to be pivotally extracted from the slot 28 and allows the closure 24 to be inserted into the slot 28, is more clearly shown in FIG. 4.

Figure 4:
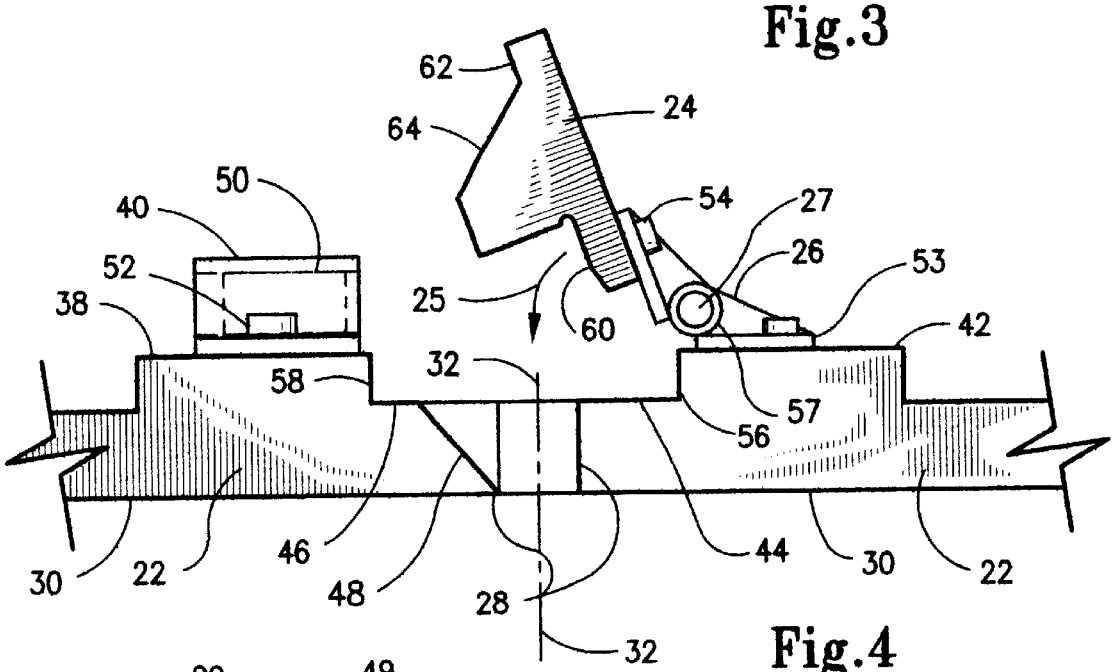
FIG. 4 shows an end view of the marine mooring line vermin shield assembly with the closure extracted from the disc slot, resulting in the closure being in an open state.

Turning to FIG. 4, an end view of the marine mooring line vermin shield assembly is shown with the closure extracted from the disc slot, resulting in the closure being in an open state, and the lock being in the unlocked state. Starting with the disc face 30, note that the closure 24 is sized and adapted to extract from the slot 28 such that the slot 28 allows the mooring line to pass through the slot 28 going from the disc periphery (not shown) to rest against the aperture (not shown). As the closure 24 is shown in the open state, the closure 24 is urged into that position manually to overcome the means for urging 26 the closure 24 into the closed state. As is shown, the means for urging the closure 26 includes the hinge 53, the spring element 57 that pivots at the hinge pivot 27 which are shown pivoted at an obtuse angle. With the closure 24 extracted from the slot 28 in the open state more clearly shown are the two rests on each side of the disc slot 28. There is a first disc closure rest 44 and a second disc closure rest 46, these respective rests respectively mate with on the closure 24 a first closure rest 60 and a second closure rest 62. Note the closure axis 25 defines the path of the closure 24 in its movement between the closed state and open state and vice versa, it is a pivotal movement based upon the function of the means for urging 26 the closure 24 into the closed state from the open state. This closure axis 25 is approximately parallel to the disc axial axis 32 meaning that the movement of the closure 24 in the action of inserting and extracting form the slot 28. respectively going from the closed state to the open state is in the disc axial axis 32 type of movement controlled by the means for urging the closure 24 into the closed state. Comparing this system to the prior art that uses either semi circular halves of the disc that mate together around the mooring line, or gravity swing doors covering a slot in the disc, or a slot with a resilient cover, the present invention is a more positive system for mounting the disc on the mooring line. This is because the urging means 26 secures the disc 22 to the mooring line without the need for fitting together large halves of a vermin guard, and is more secure in preventing vermin from getting around or through the barrier than either a gravity swing door or a resilient slot cover.

The lock 40 is also shown in the unlocked state with the lock extension 50 in the unlocked or retracted state to allow the closure 24 to be extracted from the slot 28 into the open state, and other words the lock 40 and extension 50 as shown act to clearly allow the closure 24 to move into the open state as shown. Both the lock 40 and the hinge 53 are mounted on respective supports being a lock support 38 and the hinge support 42, this is to allow the lock 40 and the hinge 53 to be at the same elevation to enable the closure 24 to be secured in the closed state when desired. Alternatively, these respective supports for the lock 38 and for the hinge 42 could be of a different height or even flush with the remaining disc 22 as long as the capabilities are preserved of having the closure 24 move from a closed to an open state, with the closure being urged or biased to the closed state, and secured by the lock 40 in the closed state as shown in FIG. 3. Fasteners are shown for securing the lock 40 to its respective support 38 and the hinge 53 to its respective support 42. These fasteners 52 for the lock 40 and fasteners 54 for the hinge 53 to the support 42 can be constructed of preferably stainless steel rivets that go completely through the disc 22 or other materials being acceptable for a marine environment. Alternatively, screws, bolts, or adhesive would be acceptable for the fasteners 52 and 54 as long as the operational requirements were met of having adequate attachment strength and suitability for a marine environment to secure both the lock 40 to the lock support 38 and the hinge 53 to the support 42. The slot 28 also includes lateral clearances and a clearance taper which allows the closure 24 to be extracted and inserted into the slot utilizing the hinge 53 as a pivot point when the closure is moved from the open state to the closed state and vice versa with the lock 40 in the unlocked state. This essentially allows a "swing" clearance for the closure 24 for insertion and extraction from the slot 28. These lateral clearances are a first disc closure clearance 56 and a second disc closure clearance 58, to allow the pivotal movement of the closure 24 at the hinge pivot 27. Also, a mating taper portion between the closure 24 and the slot 28 is described. The taper portion in the slot 28 is termed the closure clearance taper 48 and has a close clearance mating with a close clearance taper for the closure 64. This taper combination in conjunction with the lateral clearance as previously described allow the closure 24 to be pivotally extracted in the closure axis 25 from the slot 28 and allows the closure 24 to be inserted into the slot 28.

Figure 5:
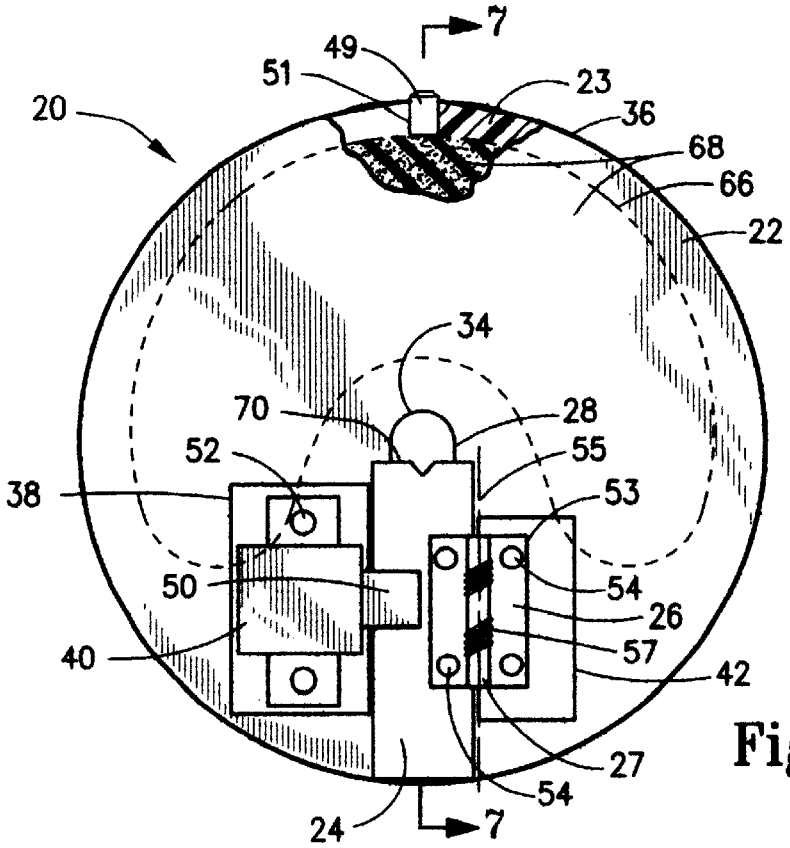
FIG. 5 shows a back view of the marine mooring line vermin shield assembly with the closure inserted into the disc slot, resulting in the closure being in a closed state secured by the lock.

Moving next to FIG. 5, shown is a back view of the marine mooring line vermin shield assembly with the closure inserted into the disc slot, resulting in the closure being in a closed state secured by the lock. More specifically, the marine mooring line vermin shield assembly 20 is shown in a back view from the side opposite of the substantially flush disc face (not shown) to clearly identify the components of the closure 24, the means for urging 26 the closure 24 from the open state to the closed state and the lock 40 with the locked extension 50 being extended to secure the closure 24 in the closed state. Also is a plug 49 that mounts in the periphery 36 of the disc 22. The disc 22 as shown assumes a round periphery 36. Although the disc periphery 36 as shown is round in shape it would be acceptable for the disc periphery 36 to assume a number of different configurations depending upon manufacturing, shipping, and use considerations. The disc periphery 36 could be square, rectangular, elliptical, egg shaped, or a polygon with any number multiple straight sides. Alternatively, as shown the disc 22 could have a two-part construction of a plastic shell 23 and an interior foam core 68, shown in cross-sectional detail in FIG. 7, wherein the foam 68 is injected at the point where plug 49 inserts into the disc periphery 36. The purpose of the plug 49 is to prevent water saturation of the foam core in the disc 22. The plug 49 is secured to the disc shell 23 by a securing means, preferably an adhesive 51, however, a press or shrink fit, threads, or any other suitable securing means for a marine environment would be acceptable between the plug 49 and disc shell 23 at the securing or attachment point 51. The general shape of the cavity for the internal foam 68 core is outlined by 66 termed the foam void, which is basically the internal portion of the disc 22 that is not consumed by the aperture 34, slot 28, lock 40 and means for urging 26 the closure 24 into the closed state. Also shown is the aperture 34 of the disc 22 that is a semi circular opening that utilizes the disc axial axis (not shown) as a centerline. The opening formed by the disc 22 aperture 34 is tangential to the slot 28 with the slot 28 width and aperture 34 diameter being substantially the same dimension as shown.

The closure 24 as shown is in the closed state by being inserted into the slot 28 as urged by the means for urging the closure 24 from the open state to the close state 26. The closure 24 has a mooring line grip portion 70 that acts to compress the mooring line and add frictional resistance to the morning line (not shown) moving relative to the closure 24. The opening formed by the disc 22 aperture 34 and the grip portion 70 provides a passageway for the mooring line which is shown more clearly in FIG. 7 and FIG. 8. The means for urging the closure 24 from the open state into the closed state can be accomplished by any number of different methods. Preferably, as shown a hinge 53 having a pivotal axis 55 is mounted on the closure 24 as shown with a support for the closure 42. Fasteners are shown for securing the lock 40 to its respective support 38 and the hinge 53 to its respective support 42. These fasteners 52 for the lock 40 and fasteners 54 for the hinge 53 to the support 42 can be constructed of preferably stainless steel rivets that go completely through the disc 22 out of materials being acceptable for a marine environment. Alternatively, screws, bolts, or adhesive would be acceptable for the fasteners 52 and 54 as long as the operational requirements were met of having adequate attachment strength and suitability for a marine environment to secure both the lock 40 to the lock support 38 and the hinge 53 to the support 42. The hinge 53 also includes a hinge pivot 27 and a spring element 57 to bias or urge the hinge to place the closure 24 in a closed state as shown.

Figure 6:
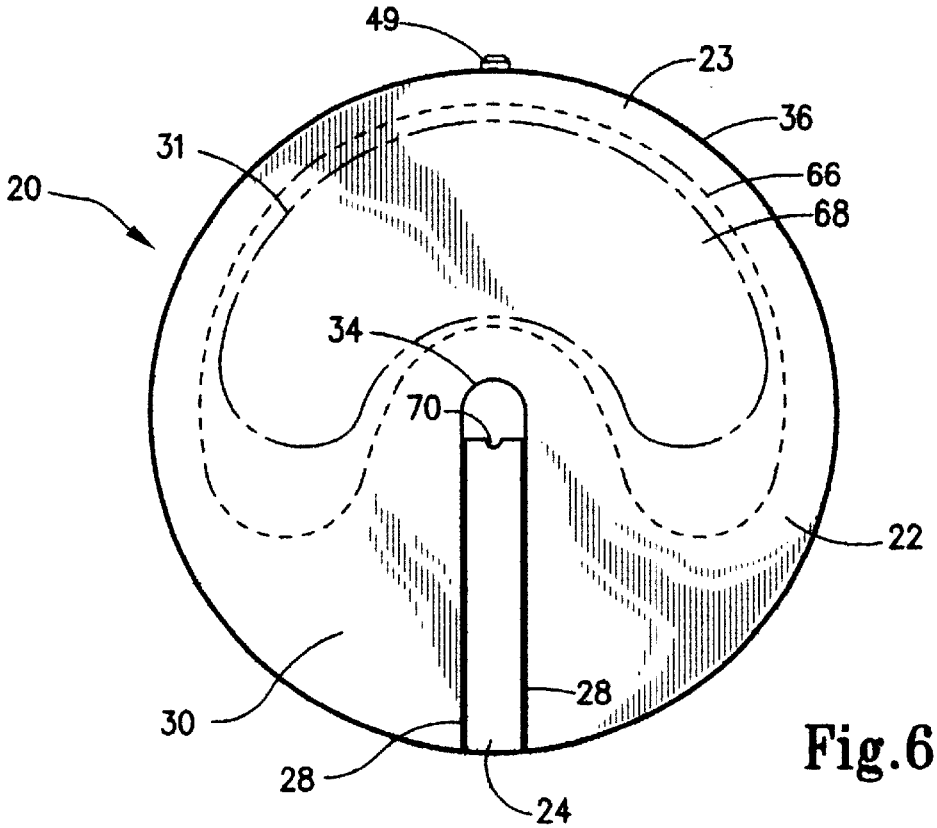
FIG. 6 shows a front view of the marine mooring line vermin shield assembly with the closure inserted into the disc slot, resulting in the closure being in a closed state.

Further going to FIG. 6, shown is a front view of the marine mooring line vermin shield assembly with the closure inserted into the disc slot, resulting in the closure being in a closed state. The mooring line vermin shield assembly 20 is shown with the disc face 30 which is the side that the vermin would encounter while crawling along the mooring line (not shown). This is desired as this face 30 is a substantially flush and continuous surface with the exception of the mooring line protruding therefrom (not shown) thus making it difficult for the vermin to gain any traction to climb up the disc face 30 to get around the vermin shield 20. It is important to note that the closure 24 when in the closed state is substantially flush with the disc face 30 forming a continuous surface to effectively block the vermin as previously described. In addition, the clearance gap between the closure 24 and the disc slot 28 is minimal to also prevent the vermin from overcoming the shield 20. A mooring line (not shown) passageway is formed by the disc aperture 34 and the grip portion 70 of the closure 24, as will be shown in FIG. 7 and FIG. 8, the grip portion 70 acts to compress the mooring line against the aperture 34.

Figure 7:
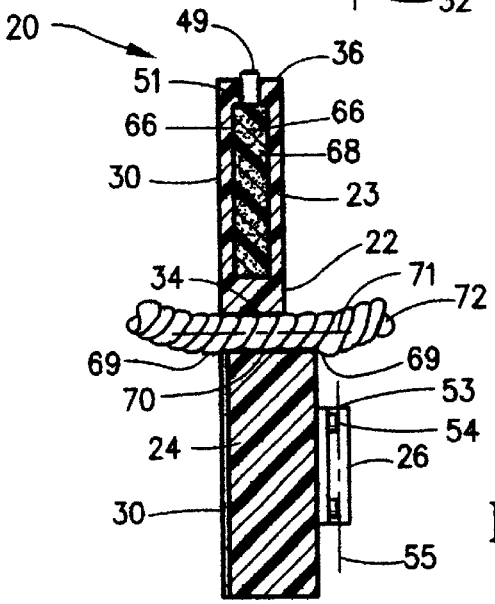
FIG. 7 shows a cross section of the marine mooring line vermin shield assembly with the closure inserted into the disc slot, resulting in the closure being in a closed state; the marine mooring line being compressed between the disc aperture and the closure, and the foam filled void.
Figure 9:
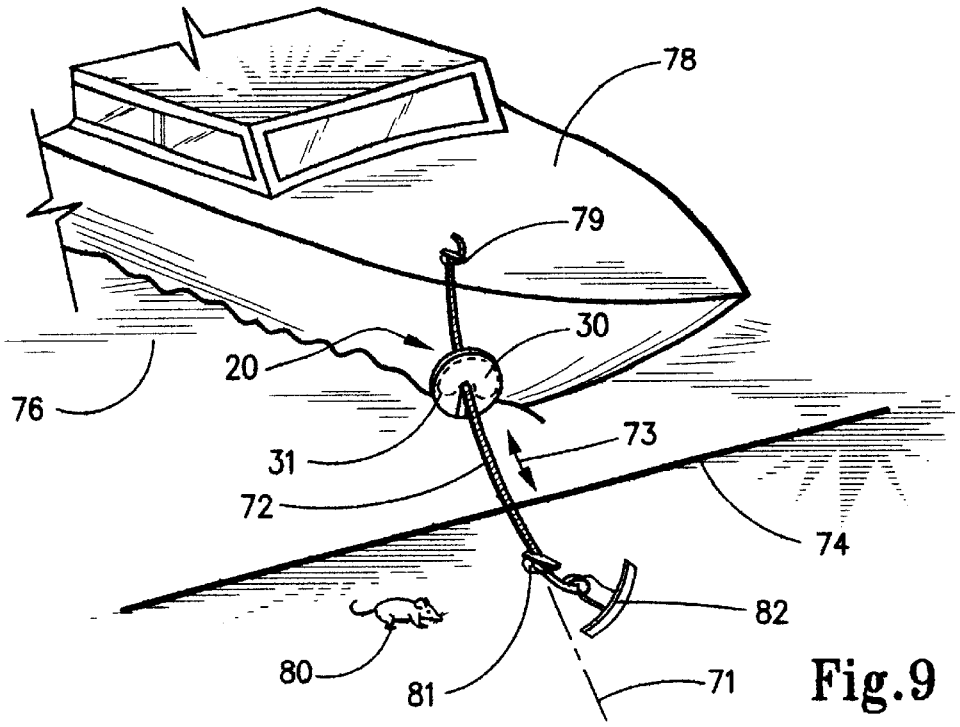
FIG. 9 shows the marine mooring line vermin shield assembly in use placed on a marine mooring line that secures the pleasure craft to the shoreline.

The alternative disc 22 two-part construction in shown from the disc face 30 side with the plastic shell 23 and an interior foam core 68, being shown in cross-sectional detail in FIG. 7, wherein the foam 68 is injected at the point where plug 49 inserts into the disc periphery 36. The purpose of the plug 49 is to prevent water saturation of the foam core in the disc 22. The general shape of the cavity for the internal foam 68 core is outlined by 66 termed the foam void. As an identification for the mooring line vermin shield assembly 20 the pleasure craft registration number can be added to the disc face 30 in the area outlined by 31 to associate the vermin shield 20 to the pleasure craft which is shown in FIG. 9.

Next, turning to FIG. 7, shown is a cross section of the marine mooring line vermin shield assembly with the closure inserted into the disc slot, resulting in the closure being in a closed state, the marine mooring line being compressed between the disc aperture and the closure, and with the foam filled void. In the alternative, as shown the disc 22 could have the two-part construction of a plastic shell 23 and an interior foam core 68, shown in cross-sectional detail, wherein the foam 68 is injected at the point where plug 49 inserts into the disc periphery 36. The foam 68 having a lower mass density that the plastic shell material occupies a volume defined by the foam void 66 outline as shown. The purpose of the plug 49 is to prevent water saturation of the foam core 68 in the disc 22. The plug 49 is secured to the disc shell 23 by a securing means, preferably an adhesive 51, however, a press or shrink fit, threads, or any other suitable securing means for a marine environment would be acceptable between the plug 49 and disc shell 23 at the securing or attachment point 51.

The mooring line 72 is shown passing through the passageway formed by the aperture 34 and the grip portion 70 of the closure 24 being in the closed state, more particularly, shown is the compression of the mooring line 72 between the grip portion 70 and the aperture 34. This compression of the mooring line 72 occurs at the portion of the mooring line 72 identified as compression portion 69 with the purpose of securing the mooring line vermin shield assembly 20 from axial movement along the mooring line 72 approximately along the mooring line axial axis 71. In addition, this securing compression of the mooring line between the grip portion 70 of the closure 24 and the aperture 34 helps to keep the disc face 30 generally perpendicular to the mooring line axial axis 71, with the purpose being to maximize the difficulty for the vermin crawling along the mooring line 72 to overcome the mooring line vermin shield assembly 20 in attempting to gain passage to the pleasure craft on the opposite side of the mooring line vermin shield assembly 20. The mooring line 72 which is termed in the art as either nylon anchor line, nylon mooring line, braided nylon anchor line, twisted nylon anchor line, or poly anchor line is preferred as it is required that the mooring line be compressible to some extent. The passageway for the mooring line 72 that is formed between aperture 34 and the grip portion 70 is preferably about one-sixteenth of an inch smaller in diameter than the outside diameter of the mooring line 72 to allow for a desirable amount of compression on the mooring line 72 when the closure 24 is in the closed state for the purpose of securing the vermin shield assembly 20 to the mooring line 72 as previously described.

Preferably, the means for urging 26 the closure 24 to the closed state from the open state, is shown as a hinge 53 having a pivotal axis 55 is mounted on the closure 24. Fasteners 54 are shown for securing the hinge 53 to the closure 24. These fasteners 54 can be constructed of preferably stainless steel rivets that go completely through the closure out of materials being acceptable for a marine environment. Alternatively, screws, bolts, or adhesive would be acceptable for the fasteners 54 as long as the operational requirements were met of having adequate attachment strength and suitability for a marine environment to secure the hinge 53 to the closure 24.

Figure 8:
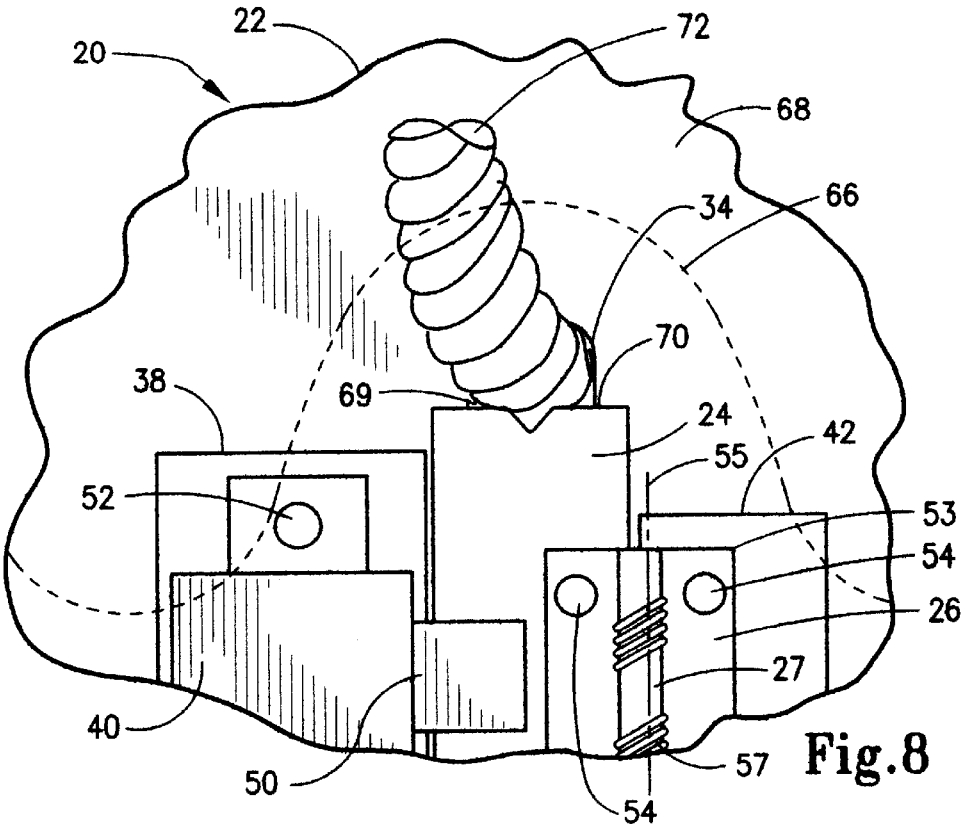
FIG. 8 shows an expanded back view of the marine mooring line vermin shield assembly with the closure inserted into the disc slot, resulting in the closure being in a closed state secured by the lock and the marine mooring line compressed between the disc aperture and the closure.

Going further on to FIG. 8, shown is an expanded back view of the marine mooring line vermin shield assembly with the closure inserted into the disc slot, resulting in the closure being in a closed state secured by the lock and the marine mooring line compressed between the disc aperture and the closure. More specifically, the marine mooring line vermin shield assembly 20 is shown in an expanded or enlarged back view from the side opposite of the substantially flush disc face (not shown) to clearly identify the components of the closure 24, the means for urging the closure 24 from the open state to the closed state 26, and the lock 40 with the locked extension 50 being extended to secure the closure 24 in the closed state. The mooring line 72 is shown passing through the passageway formed by the aperture 34 and the grip portion 70 of the closure 24 being in the closed state, more particularly, shown is the compression of the mooring line 72 between the grip portion 70 and the aperture 34. This compression of the mooring line 72 occurs at the portion of the mooring line 72 identified as compression portion 69 with the purpose of securing the mooring line vermin shield assembly 20 from axial movement along the mooring line 72.

The general shape of the cavity for the internal foam 68 core is outlined by 66 termed the foam void, which is basically the internal portion of the disc 22 that is not consumed by the aperture 34, slot (not shown), lock 40 and means for urging 26 the closure 24 into the closed state. The closure 24 as shown is in the closed state by being inserted into the slot (not shown) as urged by the means for urging 26 the closure 24 from the open state to the closed state. The means for urging 26 the closure 24 from the open state into the closed state can be accomplished by any number of different methods. Preferably, as shown a hinge 53 having a pivotal axis 55 is mounted on the closure 24 as shown with a support for the closure 42. Fasteners are shown for securing the lock 40 to its respective support 38 and the hinge 53 to its respective support 42. Fasteners 52 for attaching the lock 40 to the lock support 38 and fasteners 54 for the hinge 53 to the hinge support 42 can be constructed of preferably stainless steel rivets that go completely through the disc 22 out of materials being acceptable for a marine environment. Alternatively, screws, bolts, or adhesive would be acceptable for the fasteners 52 and 54 as long as the operational requirements are met of having adequate attachment strength and suitability for a marine environment to secure both the lock 40 to the lock support 38 and the hinge 53 to the hinge support 42. The hinge 53 also includes a hinge pivot 27 and a spring element 57 to bias or urge the hinge 53 to place the closure 24 in a closed state as shown.

METHOD OF USE

Finally turning to FIG. 9, shown is the marine mooring line vermin shield assembly in use placed on a marine mooring line that secures the pleasure craft to the shoreline. Starting with the pleasure craft 78 which can be a conventional speedboat, water-skiing boat, small fishing boat, sailboat, a house boat, or any other type of smaller marine craft. The pleasure craft 78 is floating in the body of water 76 in close proximity to land which includes either an undeveloped shoreline or a dock or marina 74. There is a deck cleat 79 shown on the pleasure craft 78 for attaching the mooring line 72 to the deck of the pleasure craft 78. Normally the other end of the mooring line 72 will either be secured to a dock cleat 81 that is mounted to the dock or marina 74 or in the case where there is no dock or marina an anchor 82 will be used that is attached to the other end of the mooring line 72 that is secured to the shoreline 74 by either burying the anchor 82 along the shoreline or securing the anchor to a rock and the like. Although a singular mooring line 72 is shown for pictorial simplicity, typically a plurality of mooring lines 72 are used to prevent the pleasure craft 78 from swinging in a pendulum type action in relation to the dock or shoreline 74 from either wind or water currents thus potentially causing damage to the pleasure craft 78 from the pleasure craft 78 contacting the dock or shoreline 74. In most cases, two mooring lines 72 are used to secure the pleasure craft 78 from the potentially damaging pendulum swinging motion. For an, even larger pleasure craft 78 such as a houseboat, four mooring lines 72 are typically used to secure the pleasure craft 78 from the potentially damaging pendulum swinging motion. Note that, each mooring line 72 requires at least one mooring line vermin shield assembly 20, thus most pleasure craft 78 would require two to four mooring line vermin shield assemblies 20.

The principal purpose of the mooring line vermin shield assembly 20 is to prevent the passage of a vermin 80 from crawling along the mooring line 72 from the dock, marina, or shoreline 74 and onto the pleasure craft 78. The mooring line vermin shield assembly 20 is provided with a disc that has an aperture and a slot, also included is a closure, a lock, and a means for urging the closure into the slot resulting in the closure being in a closed state. To install the mooring line vermin shield assembly 20 the closure must be manually extracted from the slot which requires that the means for urging the closure to insert into the slot must be manually overcome to extract closure from the slot thus opening up the slot into the aperture that is placed at the center of the disc. At this point the mooring line vermin shield assembly 20 is ready to be positioned on to the mooring line 72 such that the mooring line 72 passes through the slot of the disc to rest against the aperture. It is important to note that the disc face 30 should be positioned on the mooring line 72 to face the dock or shoreline 74 as shown. This is to ensure that the substantially flush disc surface 30 is the barrier that the vermin 80 encounters first while crawling along the mooring line 72 from the dock, arena, or shoreline 74. The next step would be to allow the means for urging the closure to insert into the slot, thus putting the closure in the closed state, wherein at this point the closure will compress the mooring line 72 against the aperture of the disc and securing the mooring line vermin shield assembly 20 against axial movement along a mooring line axial axis 71. The securing of the mooring line vermin shield assembly 20 to the mooring line 72 accomplishes three basic purposes, the first is to secure the vermin shield assembly 20 from moving along the mooring line 72 in the direction of axial movement along the mooring line 73, as the mooring line 72 is typically inclined as shown, secondly it is important to maintain the disc face 30 generally perpendicular to the mooring line axial axis 71 to maximize the barrier effect against the vermin 80. Thirdly, an optional lock can be used on the mooring line vermin shield assembly 20 to secure the closure in a closed state thus preventing theft of the mooring line vermin shield assembly 20 from the mooring line 72. Additionally, it is important to position the mooring line vermin shield assembly 20 axially on the mooring line 72 a sufficient distance from the dock or shoreline 74 such that the vermin 80 cannot jump or leap onto the mooring line 72 that is between the mooring line vermin shield assembly 20 and the pleasure craft 78 thus allowing the vermin 80 to overcome the barrier. It is recommended the mooring line vermin shield assembly 20 be positioned on the mooring line 72 at an axial location approximately one half way between the dock or shoreline 74 and the pleasure craft 78. Optionally, an identification for the mooring vermin shield 20 the pleasure craft registration number can be added to the disc face 30 in the area outlined by 31 to associate the mooring line vermin shield 20 to the pleasure craft 78.

CONCLUSION

Accordingly, the present invention of a marine mooring line vermin shield has been described with some degree of particularity directed to the embodiments of the present invention. it should be appreciated, though, that the present invention is defined by the following claims construed in light of the prior art so modifications or changes may be made to the exemplary embodiments of the present invention without departing from the inventive concepts contained therein.

What is claimed is:

1. A marine mooring line vermin shield to prevent the passage of vermin crawling along a marine mooring line from land to a pleasure craft, comprising:

(a) a disc having a disc axial axis perpendicular to a face of said disc, the disc axial axis being positioned in a central portion of said disc, said disc also includes an aperture through said disc in the disc axial axis being positioned such that said aperture uses the disc axial axis as a centerline, said aperture is sized and configured as a passage for the marine mooring line, said disc also includes a radial slot through said disc in the disc axial axis, said radial slot extending from said aperture to a periphery of said disc, said slot having a radial axis parallel to said slot;

(b) a closure sized and adapted to insert into said slot in a closure axis approximately parallel to the disc axial axis, said closure is in a closed state when inserted into said slot and is substantially flush with said disc face, said closure also sized and adapted to extract from said slot in the closure axis approximately parallel to the disc axial axis, said closure is in an open state when extracted from said slot to allow the marine mooring line to pass through said slot from said periphery to said aperture; and (c) means for urging said closure from the open state to the closed state.

2. A marine mooring line vermin shield according to claim 1 wherein said disc is constructed of a material with a mass density less than water such that said marine mooring line vermin shield floats in water.

3. A marine mooring line vermin shield according to claim 2 wherein said disc is constructed of materials selected from the group consisting essentially of polyethylene, polypropylene, and polyurethane materials.

4. A marine mooring line vermin shield according to claim 2 wherein said disc is constructed of a plastic shell material and has a core constructed of a foam material that has a lower mass density than said plastic shell material.

5. A marine mooring line vermin shield according to claim 1 wherein said closure is constructed of a corrosion resistant material.

6. A marine mooring line vermin shield according to claim 1 further including a lock to secure said closure in the closed state.

7. A marine mooring line vermin shield according to claim 6 wherein said lock is constructed of a corrosion resistant material.

8. A marine mooring line vermin shield according to claim 1 wherein said closure when in the closed state acts to compress the marine mooring line against said aperture to secure said marine mooring line vermin shield against axial movement along the marine mooring line and to keep said disc face generally perpendicular to a marine mooring line axial axis.

9. A marine mooring line vermin shield according to claim 8 wherein said closure when in the closed state has a means for gripping the marine mooring line.

10. A marine mooring line vermin shield according to claim 1 wherein said disc face is a smooth substantially continuous surface with the exception of the marine mooring line protruding therefrom, when said closure is in the closed state, wherein the vermin encounters said disc face while crawling along the mooring line to prevent passage of the vermin beyond said disc face.

11. A marine mooring line vermin shield according to claim 1 wherein said disc face has an area for placement of a pleasure craft registration number.

12. A marine mooring line vermin shield according to claim 1 wherein said means for urging said closure is pivotally oriented substantially parallel to the slot axis.

13. marine mooring line vermin shield according to claim 12 further including a hinge with a pivotal axis that is oriented substantially parallel to the slot axis.

14. A marine mooring line vermin shield according to claim 13 further including a spring element.

15. A marine mooring line vermin shield according to claim 14 wherein said hinge and spring element are constructed of a corrosion resistant material.

16. A method of using a marine mooring line vermin shield to prevent the passage of vermin crawling along a marine mooring line from land to a pleasure craft, comprising the steps of:

(a) providing a marine mooring line vermin shield that includes a disc, with an aperture, and a slot, also a closure, a lock, and a means for urging said closure to insert into said slot resulting in said closure being in a closed state;

(b) extracting said closure from said slot to place said closure in an open state by manually overcoming said means for urging;

(c) positioning said slot to allow the marine mooring line to pass through said slot and to rest against said aperture such that said disc is positioned so that a substantially flush disc face faces the land; and (d) allowing said means for urging closure to insert said closure into said slot placing said closure in the closed state, wherein said closure compresses the marine mooring line against said aperture to secure said marine mooring line vermin shield against axial movement on the marine mooring line.

17. A method of using a marine mooring line vermin shield according to claim 16 further comprising a step of locking said closure in the closed state after said step (d).

18. A method of using a marine mooring line vermin shield according to claim 16 wherein said step of positioning includes an axial positioning of said aperture on the mooring line at an axial axis mooring line midpoint between a mooring line cleat on the pleasure craft and a dock cleat.

19. A method of using a marine mooring line vermin shield according to claim 16 wherein said step of positioning includes an axial positioning of said aperture on the mooring line at an axial axis mooring line midpoint between a mooring line cleat on the pleasure craft and an anchor on a shoreline.

* * * * *